United States Patent [19]

Kanazawa

[11] 4,150,483

[45] Apr. 24, 1979

[54] HAIR CUTTING DEVICE

[76] Inventor: Yukio Kanazawa, No. 880, Sekishi-cho, Hamamatsu City, Shizuoka Prefecture, Japan

[21] Appl. No.: 806,498

[22] Filed: Jun. 14, 1977

[51] Int. Cl.[2] ..... B26B 19/44; B26B 19/20

[52] U.S. Cl. ..... 30/133; 30/201; 132/45 R

[58] Field of Search ..... 30/133, 206, 207, 208, 30/216, 221, 201; 132/45 R

[56] References Cited

U.S. PATENT DOCUMENTS

| | | | |
|---|---|---|---|
| 1,238,061 | 8/1917 | Bourdelat | 30/133 |
| 2,292,453 | 8/1942 | LaMere | 30/133 X |
| 2,722,223 | 11/1955 | Fox | 132/45 R |
| 3,260,268 | 7/1966 | Reynolds | 132/45 R |
| 3,273,237 | 9/1966 | Barcaskey | 30/133 |
| 3,979,825 | 9/1976 | Baumann | 30/133 |

*Primary Examiner*—Jimmy C. Peters
*Attorney, Agent, or Firm*—Armstrong, Nikaido, Marmelstein & Kubovcik

[57] ABSTRACT

A suction type hair cutting device which is comprised of a casing, a suction passage housed by said casing and connected to a vacuum source, and an inlet at the end of said suction passage provided with a fixed blade and an arcuate oscillatory blade. The arcuate oscillatory blade is directly driven by a crank at the output shaft of a motor mounted on the casing, or is driven by a gear mechanism which is rotatable through a flexible wire or the like, whereby the arcuate oscillatory blade is slidably oscillated relative to the fixed blade. The suction inlet is provided with means for controlling or turning air flow rearwards of said both blades which are adjacently elastically arranged to each other, so as to cut hair positively. The cutting hair length may be easily adjusted with the provision of a suction tube which can be connected to said suction inlet, the suction tube being adjustable in its axial length. Otherwise, the cutting hair length may be also easily adjusted by using a hair cutting gauge which is comprised of a head covering body of wall member of a desired thickness defining a plurality of openings for having the hair sucked therethrough, wherein the suction inlet of the hair cutting device is moved along on the outer surface of hair cutting gauge during hair cutting operation.

6 Claims, 16 Drawing Figures

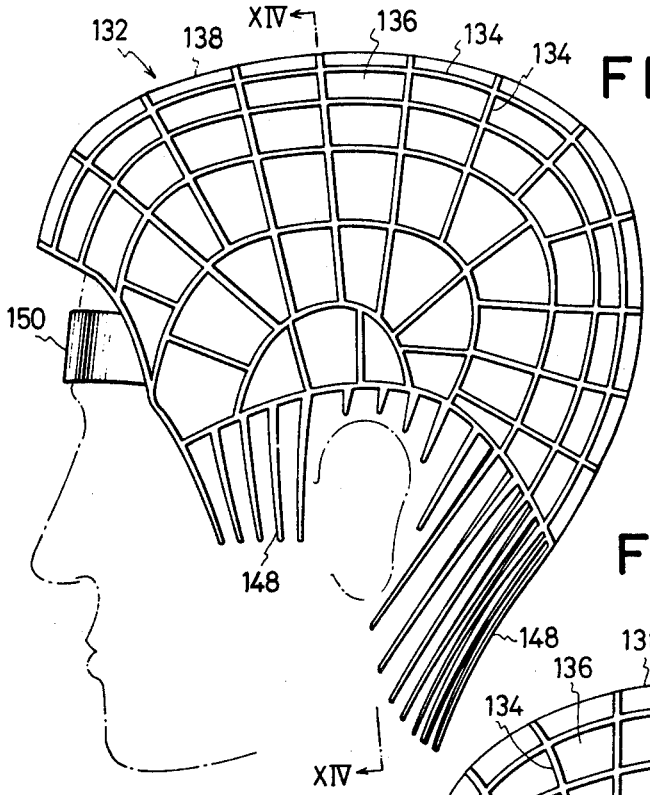
FIG. 11
FIG. 12
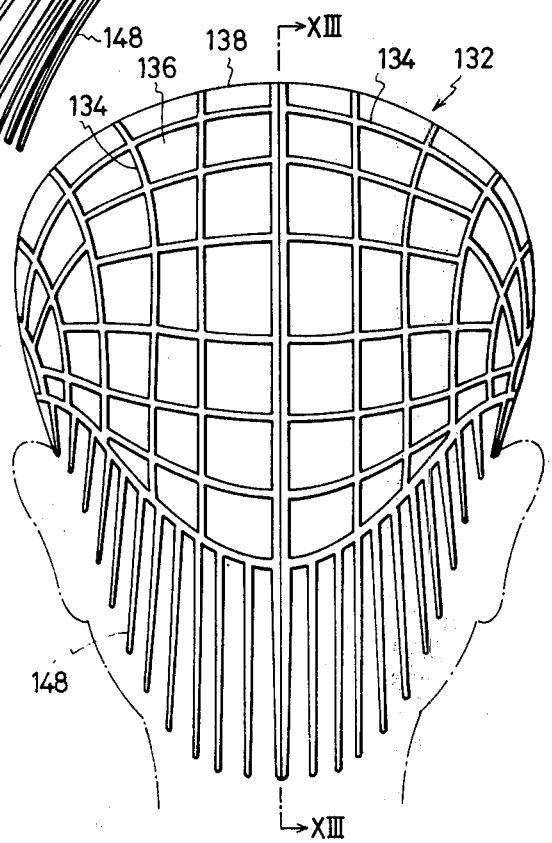

HAIR CUTTING DEVICE

This invention relates to the art of hair cutting device and more particularly to an improved suction type hair cutting device.

In hair cutting arts, heretofore, there have been used a comb and scissors, clippers, or an electric clipper, in which it is necessary a hair cutter to have some skills in the hair cutting technique. This has often prevented an unskilled person or an amateur from hair cutting at home or other places. Moreover, in the conventional devices the cut hairs are scattered on the floor where the hair is cut, resulting in a troublesome sweeping and unsanitary conditions.

It is, accordingly, the principle object of the present invention to provide a new and improved hair cutting device which needs no skill in the hair cutting, can cut hair to any desired length, and which does not scatter the cut hairs on the floor where the hair is cut.

It is another object of the present invention to provide a new and improved hair cutting device which can cut hair positively.

It is another object of the present invention to provide a new and improved hair cutting device which is simple in the structure of a casing thereof and can positively cut the hair.

It is another object of the present invention to provide a new and improved hair cutting device in which a means for interengaging a power source and an arcuate oscillatory blade is provided simple in construction.

It is another object of the present invention to provide a new and improved hair cutting device which can be easily handled during operation.

It is is a further object of the present invention to provide a new and improved hair cutting device which includes means for adjusting the hair length to be cut.

It is still further object of the present invention to provide a new and improved hair cutting device which includes a means for adjusting the length of the hair to be cut, for presenting a desired hair style.

Other and further objects, features, and advantages of the present invention will appear more fully from the following description.

FIG. 11 is a side elevational view showing a hair cutting gauge which is another preferred means for adjusting the hair length to be cut by a hair cutting device;

FIG. 12 is a rear elevational view of the hair cutting gauge of FIG. 11;

Figure 1:
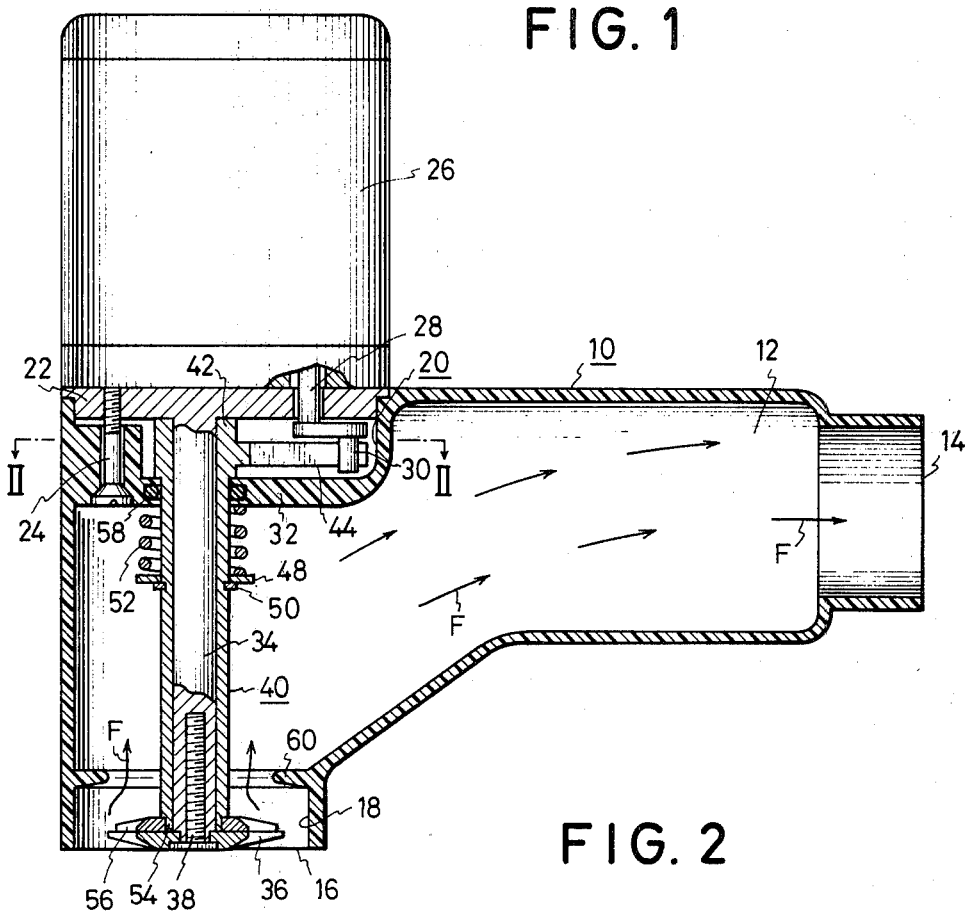
FIG. 1 is an elevational view partly in cross section showing a hair cutting device of a preferred embodiment of the present invention.
Figure 2:
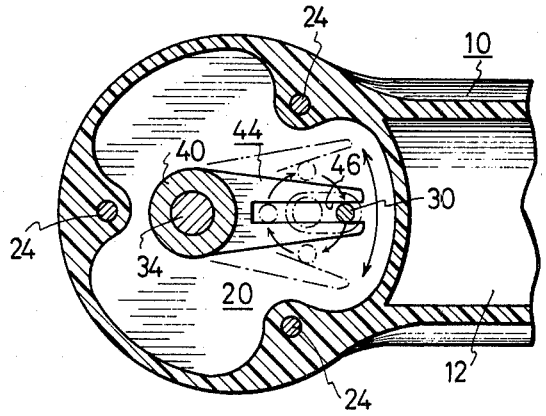
FIG. 2 is a cross sectional view taken along the line II—II of FIG. 1.

Referring now to the drawings, in FIGS. 1 and 2, a casing 10 of the hair cutting device is in the form of generally L-shaped tube defining a air passage 12 therein. The air passage 12 has opposite ends, one end being connected to a vacuum source (not shown) and the other end being provided with a suction inlet 18.

The casing 10 has a concaved portion 20 covered by a covering member 22 on which a motor 26 is mounted by means of a bolt 24. The output shaft 28 of the motor 26 vertically axially extends into the concaved portion 20 through the covering member 22 and has an end internally of the concaved portion, said end being provided with a crank means 30 within said concaved portion.

The cover 22 has a shaft means 34 vertically extending therefrom down to the suction inlet 18 through the bottom wall 32 of the concaved portion 20. A fixed blade 36 is fitted and secured to the end of the shaft 34 by means of a bolt 38.

A rotatable pipe member 40 is provided around the shaft 34 and has a link 44 transversely extending relative thereto at its base end portion 42. The link is formed with a recess 46 to receive the crank 30 therein. Accordingly the link 44 is swayed by the motion of the crank 30, and thus the pipe member 40 is reciprocably rotated.

At a predetermined axial portion of the pipe member 40, a ring 48 is engaged therearound, which ring 48 is supported by a securing piece 50 provided around the pipe member 40 at an adjacent position relative to the ring. The securing member is so positioned to prevent the movement of the ring 48 toward the forward end of the pipe member 40. A compression spring 52 is intervened between the ring 48 and the bottom wall 32, and the pipe member 40 is imposed a bias force in a direction of the forward end thereof. At the end of the pipe member 40, there formed a blade engaging stepped portion 54 rectangular in cross section, and the arcuate oscillatory blade 56 is engaged thereon for arcuate oscillatory movement cooperatively with the pipe member 40. The arcuate oscillatory blade 56 is biased toward the fixed blade 36 by the effect of the compression spring 52, the fixed blade 36 being attached to the end of the shaft 34 as before mentioned. These blades are generally in the round forms. The arcuate oscillatory blade 56 elastically and adjacently placed relative to the fixed blade 36, resulting in a positive hair cutting during operation.

Ringed air sealing member 58 is provided at the bottom wall 32 on the peripheral end thereof facing to the pipe member 40, and is engaged with the corresponding portion of the pipe member 40 so as to seal up the concaved portion 20 from the air passage 12.

A circular projection 60 is formed at the suction inlet 18 with a given axial space interior from the end 16 of the inlet 18. The fixed blade 36 and the arcuate oscillatory blade 56 are positioned near to the plane of the inlet end 16 rather than that of the circular projection 60.

The fixed blade 36 and the arcuate oscillatory blade 56 each has a circumferential end spaced from the inner surface of the suction inlet 18. The circumferential end portions of both blades positively cut hair. The suction air flow F coming from the inlet end 16 introduces the hair through both blades into around the circular projection 60 where the hair is involved behind the circumferential end of the arcuate oscillatory blade, and the hair is in a suitable position to be cut.

When thus assembled hair cutting device is operated, the hair to be cut is involved through the inlet end 16 and the circumferences of the fixed blade 36 and the arcuate oscillatory blade 56, where the hair is cut by the sliding rotation of the rotatable blade relative to the fixed blade. Then the severed hairs are carried away through the suction passage 12 to the vacuum source, not causing scattering of the hairs on the floor.

A hair cutting device of another embodiment of the present invention will be described hereinafter according to the drawings.

Figure 3:
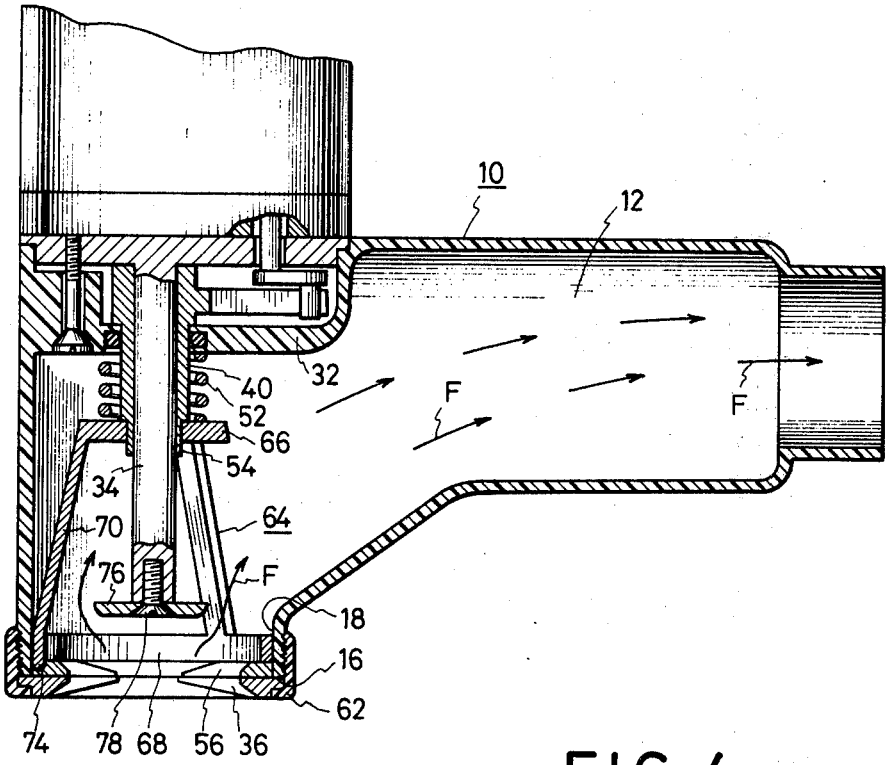
FIG. 3 is a elevational view partly in cross section showing another embodiment of the present invention.
Figure 4:
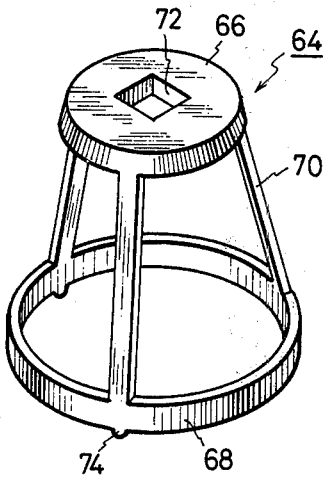
FIG. 4 is a perspective view showing connecting means of a hair cutting device of the present invention.
Figure 5:
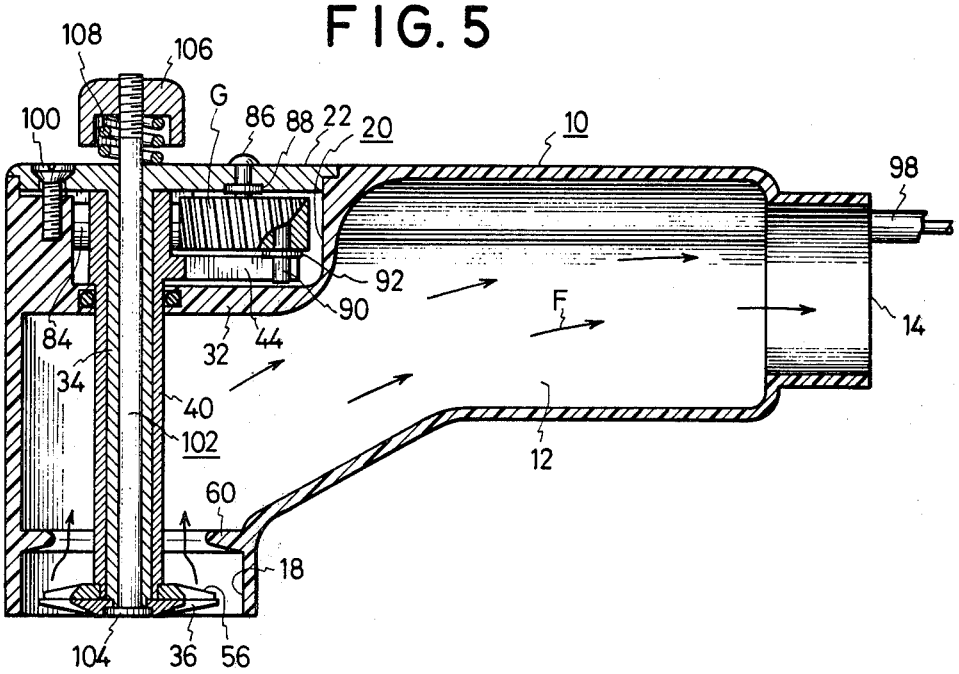
FIG. 5 is an elevational view partly in cross section showing a further embodiment of the present invention.
Figure 6:
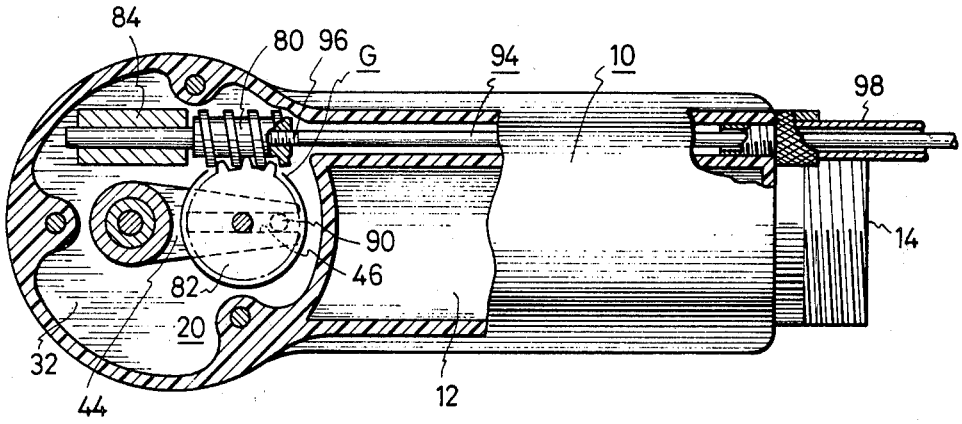
FIG. 6 is a plan view partly in cross section of the hair cutting device of FIG. 5.
Figure 7:
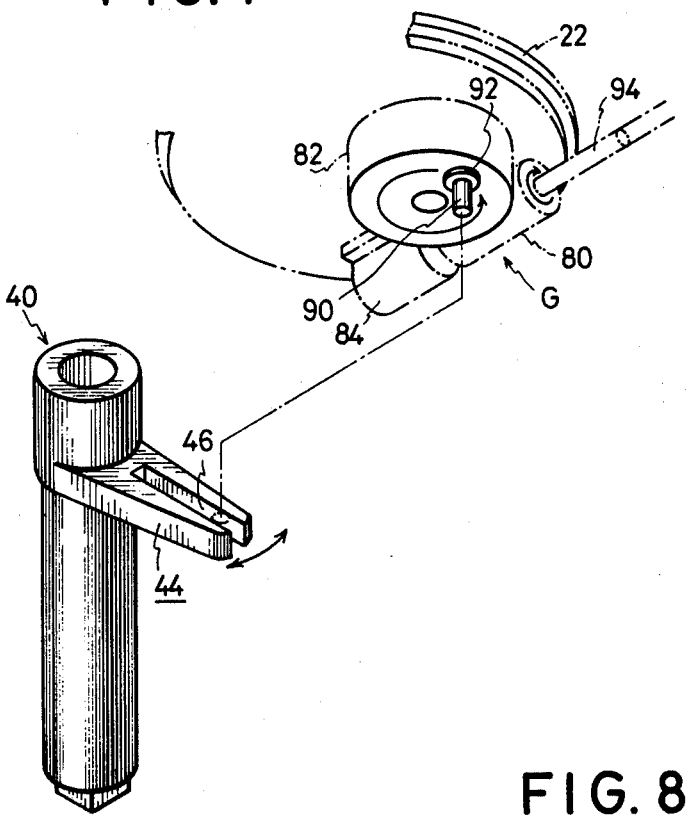
FIG. 7 is a perspective view showing a gear mechanism of the hair cutting device of FIG. 5.
Figure 8:
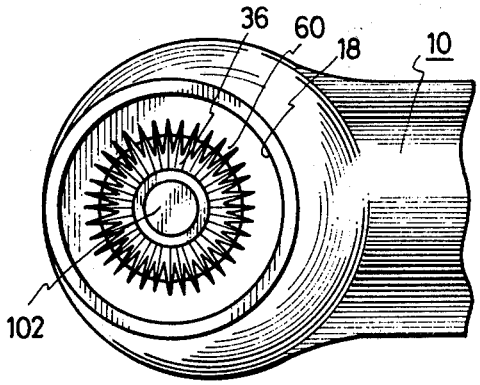
FIG. 8 is a bottom view showing a suction inlet of the hair cutting device of FIG. 5.

Referring now to FIG. 3 and 4, a fixed blade 35 and a arcuate oscillatory blade 56 are formed in circular shapes and have cutting portions at the inner peripheries thereof. More particularly, the fixed blade 36 is so formed as to be securely fitted to the end 16 of the suction inlet 18 by means of a fixing nut 62 which is threadedly engaged with the threaded outer surface of the inlet 18, while the arcuate oscillatory blade 56 is so formed as to be placed at the inner surface of the suction inlet 18 in a abutting relation to the fixed blade 36.

The arcuate oscillating blade 56 is interconnected with the pipe member 40 through a connecting means 64. The connecting means 64 includes a circular plate 66, supporting bars 70 extending downwards therefrom to a given length, and a ringed piece 68 fitted to each end of the bars 70. The circular plate 66 is engaged with a rotatable pipe member 40, and the ring 68 is engaged with the arcuate oscillatory blade 56, thus enabling an arcuate oscillatory movement of the blade 56 during operation.

The circular plate 66 has a rectangular through hole 72 in the center portion thereof, through which the pipe member 40 is extended in a manner that the connecting means 64 is securely connected thereto at a stepped portion 54, thus the connecting means 64 being cooperatively movable therewith.

Compression spring 52 is intervened between the plate 66 and the bottom wall 32 of the concaved portion of the casing 10, so that the connecting means 64 is biased in the direction of the forward end 16 of the device.

The ringed piece 68 has a plurality of projections 74 at the circumferential end facing to the arcuate oscillatory blade 56, for engaging with the blade 56. Accordingly, the projections 74 are contact with the arcuate oscillatory blade 56, and thus the arcuate oscillatory blade 56 is biased to the fixed blade 36.

At the end of the shaft 34, there provided with a air flow turning or controlling plate 76 transversely relative thereto and secured by the bolt 78, which plate 76 is in a position spaced over from the blades 36 and 56, and is a size allowing a sufficient air flow for hair cutting operation. Accordingly, the air flow F coming from the inlet end 16 is passed through the inner circumferential ends of the fixed blade 36 and the arcuate oscillatory blade 56, then through around the plate 76, into the suction passage 12.

In thus assembled hair cutting device, the hair sucked up through the inlet end 16 is involved behind the arcuate oscillatory blade 56, because of the effect of the air flow turning plate 76, resulting in a positive hair cutting operation.

The hair cutting device of this embodiment wherein the hair is cut by the inner circumferencial ends of the circular fixed blade 36 and arcuate oscillatory blade 56, is dispensed with a circular projection 60 in the inlet 18 and is simplified in the structure of the casing 10.

Further in this second embodiment of the present invention, the structure of the pipe member 40 is simplified, because the spring 52 is received by the circular plate 66, instead of the ring 48 and the securing member 50 as in the first embodiment shown in FIG. 1. Accordingly, the hair cutting device may be assembled in reduced steps.

Referring now to FIG. 5 to FIG. 8, which show the third embodiment of the present invention, the gear mechanism G is accomodated in the concaved portion 20 of the casing 10, which gear mechanism G is comprised of a worm 80 and a worm gear 82 interengaged with one another. The worm 80 is in a position axially aligned with and spaced from the boss 84, the boss 84 being formed on the inside surface of the cover 22. The worm gear 82 is rotatably journalled by means of a pin 86 which is vertically extending from the outside of the cover 22 into the center portion of the worm gear 82. A portion along the axial length of the pin 86 is secured with a retaining ring 88 provided on the inner surface of the cover 22.

The worm gear 82 is further provided with a pin 90 vertically extending therethrough. The pin 90 is engaged with the recess 46 is the link 44 provided in the pipe member 40, and is securely surrounded with a retaining ring 92 at a portion thereof, where the retaining ring 92 is adjacently placed between the lower surface of the worm gear 82 and the upper surface of the link 44. Thus the pin 90 is not fallen out from the link 44.

A flexible wire member 94 has one end connected to the end 96 of the worm 80. The wire member 94 is extending through the casing 10 longitudinally along the air passage 12, and is drawn out of the end 14 of the casing 10. The wire member 94 has the other end connected to the power source (not shown), in common with the vacuum source (not shown), and transfers the rotational motion to the worm 80 therefrom.

The wire member 94 is shielded with a protective tube 98 of flexible material to the length between the end 14 of the casing 10 and the power source. The worm 80 is driven through the wire member 94 and thus the worm gear 82 is rotated. The rotation of the worm gear 82 imparts the reciprocable movement to the link 44 through the pin 90. This results in reciprocable motion of the arcuate oscillatory blade 56.

The cover 22 is positioned over the casing 10 with a bolt 100, so as to seal up the concaved portion 20. An axis 102 extends through the axial length of the shaft 34 vertically extending from the cover 22, and the upper end of the axis 102 appears over the cover 22. The axis 102 has a lower end 104 of large dimention which is positioned at the end of the inlet 18 when the axis 102 is inserted, and which biases the fixed blade 36 against the rotatable blade 56.

The upper end of the axis 102 is threadedly engaged with a thumb nut 106. A spring 108 is provided between the thumb nut 106 and the outer surface of the cover 22 so as to elastically bias the fixed blade 36 toward the arcuate oscillatory blade 56.

The hair cutting device of this third embodiment of the present invention can be handled quite easily, because there is no need to provide a motor on the casing 10, as in the formerly described embodiments, and the wire member 94 instead of a motor is employed for connecting the body of the hair cutting device to power source.

Further an unitary power source is used for driving the wire member 94 and a vacuum pump, and accordingly a simple construction is resulted.

Figure 9:
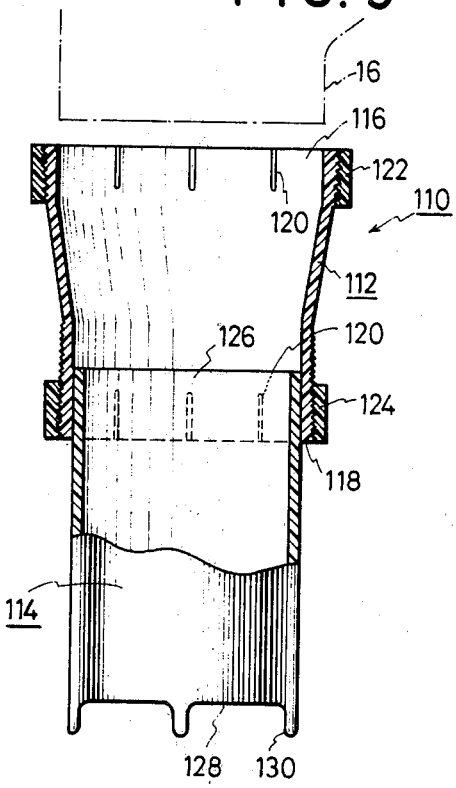
FIG. 9 is a elevational view partly in cross section showing a suction type which is a preferred means for adjusting the hair length to be cut by a hair cutting device.

For adjusting the hair length to be cut, the suction tube 110 may be used as shown in FIG. 9. The suction tube 110 is comprised of an upper tube member 112 and a lower tube member 114, the lower tube member 114 telescoped into the upper tube member 112. The tube member 112 has an upper end portion 116 and a lower end portion 118 each formed with short vertically extending slits 120, so that the diameter of each end may be extensibly and reducibly varied. Nuts 122 and 124 are threadedly engaged with the corresponding outer surfaces of the end portions 116 and 118, respectively. Accordingly, the threaded engagement of the nut 122 with the upper end portion 116 reduces the diameter of the end portion 116 and then the tube 110 may be securely attached to the inlet end 16 of the hair cutting body. Also the threaded engagement of the nut 124 with the lower end portion 118 reduces the diameter of the end portion 118, and the lower slidable tube member 114 can be securely attached to the upper tube member 112.

The lower tube member 114 has an upper end 126 telescoped into the lower end 118 of the upper tube member 112, and a lower end 128 formed with a plurality of projections 130.

When the suction tube 110 is connected to the hair cutting device, in the manner as the end 116 of the suction tube 110 telescoped over the end 16 of the hair cutting device, the hair length to be cut will be the length over the effective length of the suction tube 110. The hair length to be cut may be variable to a desired length, by axially adjusting the axial length of the tube 110. The length of the tube 110 can be easily variable by loosening the nut 124 and axially sliding the lower tube member 114 along the upper tube member 112. The slidable tube 114 is formed with a plurality of projections at the lower end thereof to keep the interstices for air passing during operation. Accordingly, the hair cutting operation can be easily processed.

Another means for adjusting the cutting hair length will be hereinafter described.

Referring now to the FIGS. 11 to 14, the hair cutting gauge 132 is a head covering body comprised of wall member 134 having a desired thickness and defining a plurality of openings 136 in honeycomb-like shape or grid pattern covering all over the head. The hair cutting gauge 132 has an outer surface 138 configurated in a shape according to a desired hair style, and an inner surface 140 provided with a plurality of short projections 142 at a given portions thereon for retaining a suitable interstices 146 between the head surface 144 and the inner surface 140 when the gauge is put on the head. The hair cutting gauge 132 may be formed thinner at the back end portion and both side portions as desired, thereby presenting comb-like pattern as shown by numeral 148. In this respect, any configuration of the hair cutting gauge may be used according to the request of a person whose hair is cut.

Figure 15:
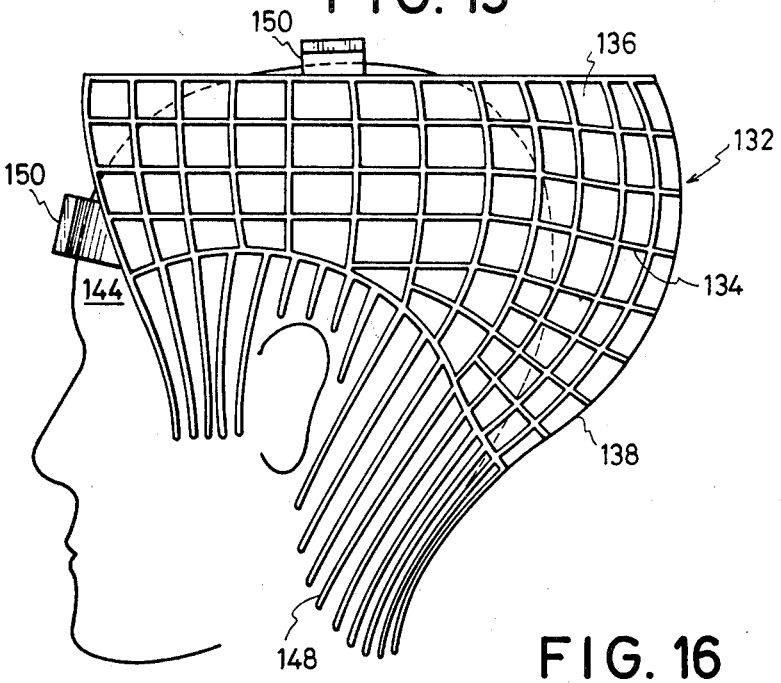
FIG. 15 is a side elevational view showing another embodiment of the hair cutting gauge.
Figure 16:
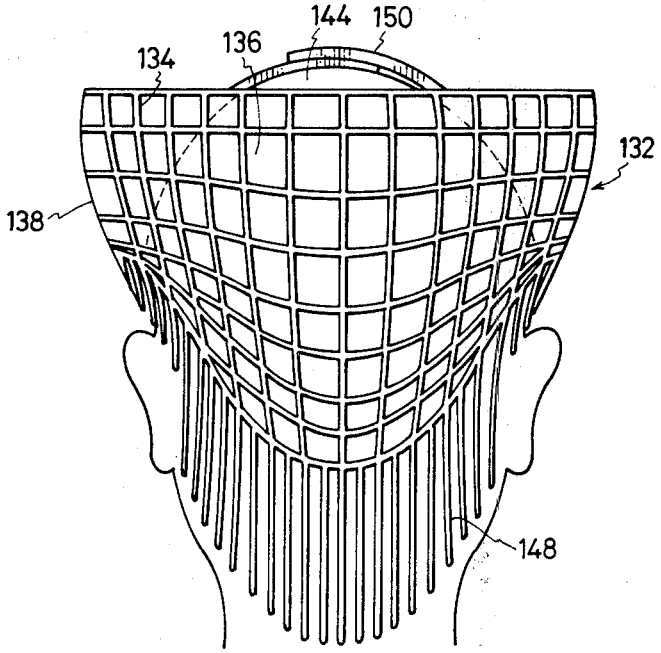
FIG. 16 is a rear elevational view showing the hair cutting gauge of FIG. 15.

The gauge may be formed in such a shape which does not cover the top portion of the head as shown in FIGS. 15 and 16, and the gauge may be attached on a suitable head position according to the size of a head, by sliding the gauge along the head.

Numeral 150 is a band for fixing the gauge 132 on the head 144, and numeral 152 is a suction type hair cutting device having a suction inlet 18 and cutting blades 36 and 56.

In hair cutting, the gauge 132 is put on the head 144 and fixed by the band 150, and then the hair cutting device 152 is moved along on the outer surface 138 of the gauge 132, whereby all the hair is sucked through the openings 136 and cut in a shape determined by the type of the gauge used. When the hair cutting device is operating at one opening, the hair around that opening is also sucked up through the interstices 146, and thus un-uniform or irregular hair cutting can be eliminated.

Referring to FIGS. 15 and 16, when the gauge 132 with no covering for the top half of the head is employed, the lower half of the head is cut along the gauge 132, and the top half may be cut with the use of suction tube 110 of a given length which is attached to the end of the hair cutting device 152.

Thus desired hair cutting can be presented in accordance with the elected type of a gauge. Accordingly, one can have his hair cut in his favorite hair type by his election, if the various types of the gauges are stored.

Figure 10:
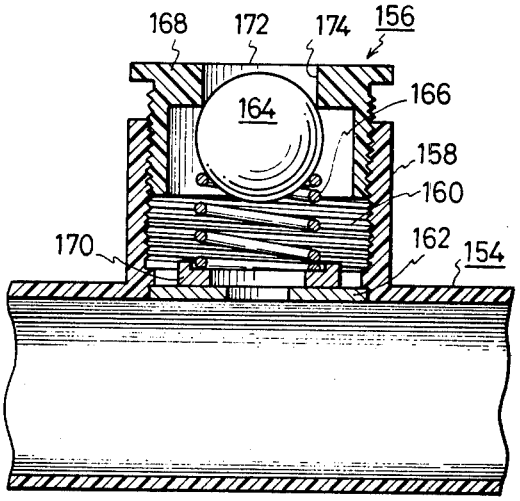
FIG. 10 is a cross sectional view showing a pressure regulating valve means used for a hair cutting device of the present invention.
Figure 13:
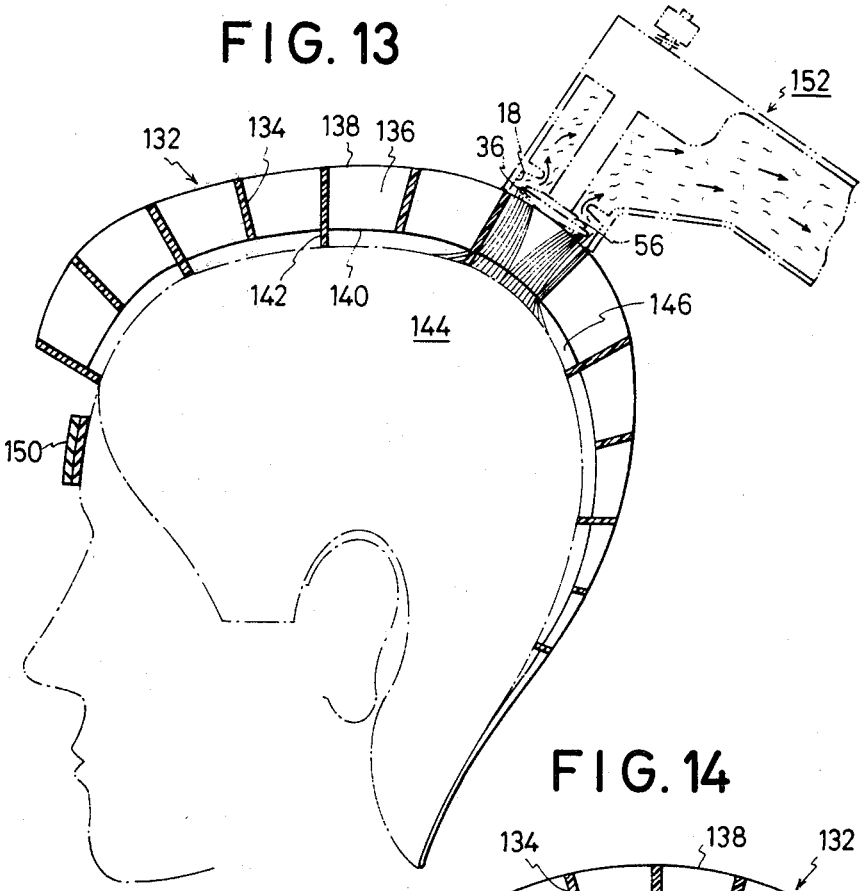
FIG. 13 is a cross sectional view taken along the line XIII—XIII of FIG. 12.
Figure 14:
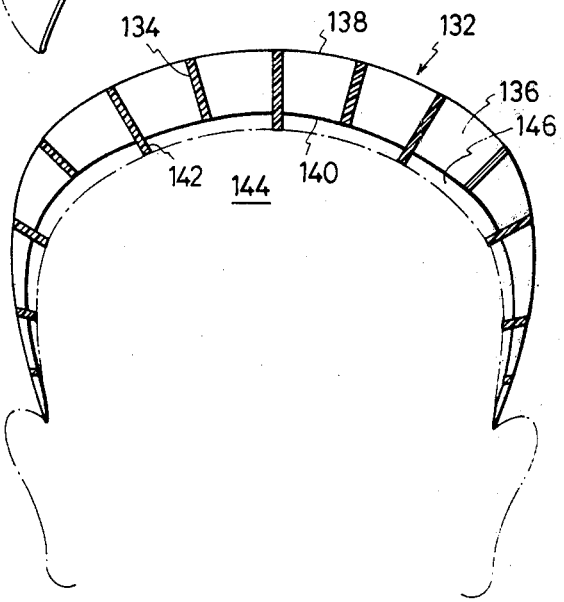
FIG. 14 is a cross sectional view taken along the line XIV—XIV of FIG. 11.

As shown in FIG. 10, a pressure regulating valve means 156 is provided on a tube line 154. The tube line 154 is connected to the basic end 14 of the air passage 12 at one end, and the vacuum source at the other end, thereby intercommunicating the air passage 12 to the vacuum source. The pressure regulating valve 156 controls the pressure in the tube line 154. On a given portion of the tube line 154, an opening defined by a wall 158 is provided for receiving therein the pressure regulating valve 156. The inner surface of the wall 158 is threadedly engaged with the outer side surface of the valve 156, and a ring 162 is securely fit to the bottom end of the wall 158. The pressure regulating valve 156 is comprised of a ball 164, a compression spring 166 disposed just under the ball 164, and a cylinder 168 housing the ball 164 and the spring 166 therein, the compression spring 166 forcing the ball 164 onto the wall of the cylinder 168. The spring 166 is supported by the ring 162 through a washer 170.

The cylinder 168 has a hole 174 opening to its top surface 172, to the inside wall of which the ball 164 is forcibly fitted.

As the cylinder 168 is threadedly engaged with the threaded wall 158 extending from the tube line, the pressure of the ball 164 relative to the hole 174 can be controlled by axially adjusting the threaded engagement of the cylinder 168 relative to the wall 158. The ball 164 is forced toward the ring 162 when the pressure in the tube line 154 is lowered to a value less than a certain value determined by a compression force of the spring 166. When this happened, air is introduced from the hole 174, resulting in increasing the pressure in the tube line 154. Accordingly, when the lower end 128 of the suction tube 110 is sealed with hair or the head skin, the pressure in the tube line 154 is instantly increased and such sealing situation is readily removed.

Any type of vacuum sources may be applicable to a hair cutting device of this invention, and it should be noted that an electric home cleaner can be a vacuum source of this invention and is easily connected to the end of the tube line 154. This eliminates the necessity to provide a particular vacuum source used only for the hair cutting device, and moreover facilitates to completely collect cut hairs, bringing out good advantages in home hair cutting.

When the pressure regulating valve means 156 is not employed, the basic end 14 of the air passage 12 of the hair cutting device may be directly connected with the top end of the tube of electric home cleaner. As shown in FIGS. 1, 3, 5 and 7, the basic end 14 of the air passage 12 is designed in a manner to be easily connected to the tube end of the electric home cleaner.

As described hereinabove, the hair cutting device of the present invention provides many advantages in hair cutting wherein a fixed blade and an arcuate oscillatory blade are disposed in the suction inlet of the air passage in elastically adjacent relationship to each other, the hairs cut by said blades are passed through the air passage into the vacuum source without being scattered on the floor, and the cutting hair length can be easily adjusted with the use of the suction tube variable in its axial length.

The invention has been described in reference to a preferred embodiments. Obviously, modifications and alterations will occur to others upon a reading and understanding of the present specification and it is my invention to include all such modifications and alterations in so far as that come in the scope of the appended claims.

What is claimed is:

1. A suction type hair cutting device comprising a casing having an air passage therethrough, one end of said air passage forming a suction inlet and the other end of said air passage being adapted for connection to a vacuum source; a fixed circular blade positioned in said suction inlet; an arcuately oscillatory circular blade positioned adjacent to said fixed blade and arcuately oscillatory with respect thereto; and an annular projection formed around the inner surface of said suction inlet, wherein said fixed blade and said arcuately oscillatory blade are positioned with respect to said annular projection to form an air flow passage therebetween.

2. A suction type hair cutting device as set forth in claim 1 including a motor means having an output shaft, mounted on said casing; a crank means for coupling said output shaft to said arcuately oscillatory blade for reciprocating said arcuately oscillatory blade in an arcuate oscillatory movement with respect to said fixed blade; and means for elastically biasing said arcuately oscillatory blade towards said fixed blade.

3. A suction type hair cutting device defined in claim 1, wherein a means for controlling or turning air flow is provided in said suction inlet, said fixed blade and said arcuately oscillatory blade are disposed at a position nearer to the forward end of the air passage than said air flow turning means, both of said blades being formed in circular shape and having cutting portions at respective inner peripheries.

4. A suction type hair cutting device defined in claim 1, wherein said arcuately oscillatory blade is interengaged with a gear mechanism, said gear mechanism being driven through a flexible wire connected thereto.

5. A suction type hair cutting device defined in claim 1, including a suction tube connected to said suction inlet, said suction tube being adjustable in its axial length.

6. A suction type hair cutting device defined in claim 1, including a hair cutting gauge, said hair cutting gauge being formed with a head covering body of wall member defining a plurality of openings in a grid pattern, the inner surface of said gauge having a plurality of projections for retaining a given space between said inner surface and a head when the gauge is put on the head, the outer surface of said gauge having a configuration corresponding to desired hair length, wherein said hair cutting device is slidably operated along the outer surface of said gauge.

* * * * *